US007588449B2

(12) United States Patent
Takehara

(10) Patent No.: US 7,588,449 B2
(45) Date of Patent: Sep. 15, 2009

(54) CONNECTOR STRUCTURE

(75) Inventor: Hideaki Takehara, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 11/680,836

(22) Filed: Mar. 1, 2007

(65) Prior Publication Data

US 2007/0218747 A1 Sep. 20, 2007

(30) Foreign Application Priority Data

Mar. 15, 2006 (JP) ..... 2006-070911
Jun. 22, 2006 (JP) ..... 2006-173072

(51) Int. Cl.
*H01R 13/64* (2006.01)

(52) U.S. Cl. ..... 439/247

(58) Field of Classification Search ..... 439/247, 439/248, 384, 382
See application file for complete search history.

(56) References Cited

U.S. PATENT DOCUMENTS 1,860,178 A * 5/1932 Gunther ..... 267/136
1,991,184 A * 2/1935 Towner ..... 267/31
2,004,610 A * 6/1935 Jones ..... 439/382
2,096,621 A * 10/1937 Skolfield ..... 248/604
2,347,969 A * 5/1944 Rubly et al. ..... 248/573
2,380,899 A * 7/1945 Strachovsky ..... 267/140.11
2,498,126 A * 2/1950 Koch ..... 248/606
2,686,868 A * 8/1954 Diedring ..... 362/267
2,783,417 A * 2/1957 Eannarino ..... 257/658
3,363,218 A * 1/1968 Breivogel ..... 439/384
3,680,038 A * 7/1972 Johnson ..... 439/325
3,770,232 A * 11/1973 Blake ..... 267/140.4
4,378,936 A * 4/1983 Brenner ..... 267/140.13
4,568,068 A * 2/1986 Kimura et al. ..... 267/140.13
5,131,867 A * 7/1992 Peloza et al. ..... 439/557
5,463,541 A * 10/1995 Greene ..... 362/369
5,613,867 A * 3/1997 Hotea ..... 439/271
5,707,023 A * 1/1998 Ichikawa et al. ..... 242/388
5,752,845 A * 5/1998 Fu ..... 439/247
5,861,689 A * 1/1999 Snider et al. ..... 310/71

(Continued)

FOREIGN PATENT DOCUMENTS

JP 6-219607 A 8/1993

(Continued)

OTHER PUBLICATIONS

Chinese Office Action dated Feb. 20, 2009 (Ten (10) pages).

*Primary Examiner*—Tulsidas C. Patel
*Assistant Examiner*—Vladimir Imas
(74) *Attorney, Agent, or Firm*—Crowell & Moring LLP

(57) ABSTRACT

A connector structure that can be less subject to the vibration of the equipment coupled to the connector is provided. In the inverter apparatus side connector structure, a packing, an insulation member, another packing and a terminal housing are fixed at the outer circumference of the inverter apparatus side terminal with its one end being formed as a male terminal structure having an approximately circular solid cylindrical shape, and the terminal housing is fixed at the inverter apparatus side housing with the dissipation member of vibration. The motor side connector structure is fixed at the motor side housing with the packing, etc. at the outer circumference of the motor side terminal with its one end being formed as a female terminal structure having an approximately circular hollow cylindrical shape.

4 Claims, 9 Drawing Sheets

U.S. PATENT DOCUMENTS

| | | | | |
|---|---|---|---|---|
| 5,975,453 | A * | 11/1999 | Sakata et al. | 242/388 |
| 6,019,621 | A * | 2/2000 | Sugata et al. | 439/164 |
| 6,206,712 | B1 * | 3/2001 | Norizuki et al. | 439/247 |
| 6,377,062 | B1 * | 4/2002 | Ramos et al. | 324/758 |
| 6,390,841 | B1 * | 5/2002 | Zaguskin | 439/248 |
| 6,422,885 | B2 * | 7/2002 | Kain et al. | 439/247 |
| 6,428,353 | B2 * | 8/2002 | Mochizuki | 439/545 |
| D473,845 | S * | 4/2003 | Bender et al. | D13/133 |
| 6,592,387 | B2 * | 7/2003 | Komenda et al. | 439/247 |
| 6,837,727 | B2 * | 1/2005 | Migimatsu et al. | 439/247 |
| 7,090,521 | B2 * | 8/2006 | Nishio et al. | 439/248 |
| 7,186,131 | B2 * | 3/2007 | Kurtz et al. | 439/382 |
| 7,201,594 | B2 * | 4/2007 | van der Mee et al. | 439/247 |
| 7,234,950 | B1 * | 6/2007 | Wickett | 439/78 |
| 7,238,037 | B2 * | 7/2007 | Chen | 439/247 |
| 7,458,837 | B2 * | 12/2008 | Mineo | 439/248 |
| 2002/0031931 | A1 * | 3/2002 | Yokoyama et al. | 439/247 |
| 2004/0185702 | A1 * | 9/2004 | Kurtz et al. | 439/382 |
| 2005/0083071 | A1 * | 4/2005 | Hartnett et al. | 324/754 |
| 2005/0239309 | A1 * | 10/2005 | Scafidi et al. | 439/247 |

FOREIGN PATENT DOCUMENTS

| | | | |
|---|---|---|---|
| JP | 2004-312863 | A | 11/2004 |

* cited by examiner

CONNECTOR STRUCTURE

BACKGROUND OF THE INVENTION

The present invention relates to a connector structure for connecting terminals of the equipment, and specifically to a connector structure preferable for the environment in which vibration occurs in connecting between the power converter apparatus and the electric motor used in the vehicle.

In general, electric vehicles and hybrid electric vehicles have a power converter apparatus and an electric motor between the battery and the wheels in order to drive the wheels by using the electric power stored in the battery. The electric power stored in the battery is converted by the power converter apparatus such as inverter apparatus and supplied to the electric motor, and the rotational motion of the electric motor is transmitted through the differential gear to the wheels and finally provided for driving the wheels.

In the conventional configuration, the power converter apparatus and the electric motor are installed separately at the different places in the vehicle, and the terminals of the power converter apparatus and the terminals of the electric motor are connected by the electric cables. On the other hand, some patents, for example, Japanese Laid-Open Patent Number 5-219607 (1993) and Japanese Laid-Open Patent Number 2004-312853, disclose such a structure that the power converter apparatus and the electric motor are integrated into a single unit together for downsizing and cost-reduction of the electro-mechanical driving system from the battery to the wheels.

SUMMARY OF THE INVENTION

In such a structure for integrating the power converter apparatus and the electric motor, as for the fabrication process, after assembling the power converter apparatus and the electric motor separately, the power converter apparatus may be installed at the neighborhood of the electric motor and then the terminals of the power converter apparatus, and then the terminals of the electric motor may be connected by the connectors. In this fabrication process, as the power converter apparatus and the electric motor can be assembled separately as independent modules and they can be connected by the connectors for integrated them into a single unit, it will be appreciated that the fabrication process can be made easier and the cost reduction in the fabrication process can be realized. In this structure, the vibration of the power converter apparatus and the electric motor caused by the vibration of the vehicle body in operation is applied to the coupling part of the connector, which may lead to the possibility for causing the mechanical damage at the coupling part of the connector. Thus, it is desired to provide a connector structure that can be less subject to such vibration.

An object of the present invention is to provide a connector structure that can be less subject to the vibration of the equipment coupled to the connector in such a case that the terminals of the power converter apparatus and the terminals of the electric motor, both installed at the vehicle are connected together.

[Means for Solving the Problems]

In order to achieve the above object, the connector structure of the present invention is characterized as the connector structure for connecting between the terminal of the first equipment and the terminal of the second equipment, which comprises the housing of the first equipment, the terminal of the first equipment, the housing of the second equipment and the terminal of the second equipment, in which the terminal of the first equipment is installed at the housing of the first equipment through a dissipation member of vibration, and the terminal of the second equipment is fixed at the housing of the second equipment.

According to the connector structure of the present invention, as the terminal of the first equipment is installed at the housing of the first equipment through a dissipation member of vibration, and the terminal of the second equipment is fixed at the housing of the second equipment, it will be appreciated that the excessive load may not be applied to the coupling part of the connector and such a bad influence as mechanical damage may not be exerted because vibration applied to the first equipment and the second equipment, if any, can be absorbed by the dissipation member of vibration.

DETAILED DESCRIPTION OF THE PREFERRED EMBODIMENTS

Now, referring to the attached figures, the preferred embodiments of the present invention will be described below.

In the preferred embodiment described below, an inverter apparatus is taken as an example of the power converter apparatus and a motor (three-phase current electric motor) is taken as an example of the electric motor. The inverter apparatus converts the DC power supplied by the battery to the AC power and supplies the AC power to the motor, and drives and controls the motor. Note that "power converter apparatus" is not limited to the inverter apparatus in the scope of the claims of the present invention and in the specification of the present invention, and may include another kind of power converter apparatus such as DC-to-DC power converter apparatus and AC-to-DC power converter apparatus, and that "electric motor" may include DC motor, AC motor, generator and motor generator.

Embodiment 1 Structure

Now, referring to FIGS. 1 to 5, the first embodiment of the present invention will be described.

Figure 1:
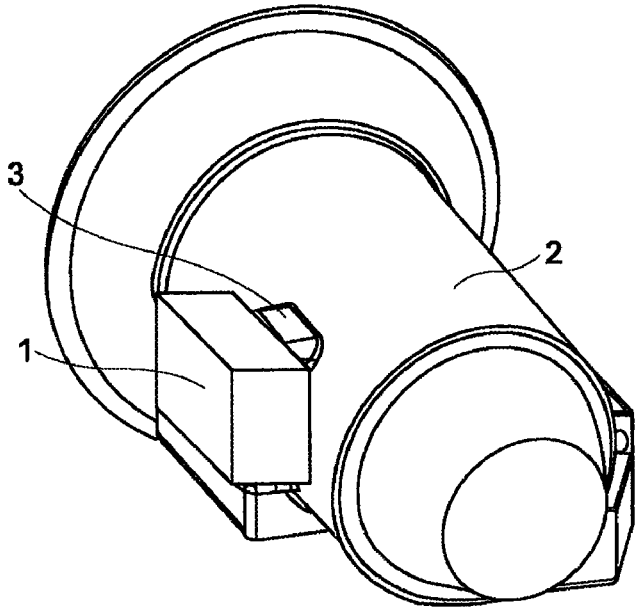
FIG. 1 is a perspective view of the coupling part between the inverter apparatus and the motor to which the present invention is applied.

FIG. 1 is a perspective view of the coupling part between the inverter apparatus and the motor to which the connector structure of the present invention is applied. The inverter apparatus 1 is connected to the battery (not shown) through the electric cable (not shown), and the DC power is supplied from the battery to the inverter apparatus 1. The inverter apparatus 1 is connected to the control part (not shown) through the electric cable, and the control signal is supplied from the control part to the inverter apparatus 1. The inverter apparatus 1 converts the DC power supplied by the battery to the designated AC power in response to the control signal. A motor (three-phase current electric motor) is installed inside the transmission 2, and the output axis of the motor is mechanically coupled to the differential gear (not shown). The inverter apparatus 1 is arranged at the neighborhood of the transmission 2, and the terminals of the inverter apparatus 1 and the terminals of the motor are connected electrically inside the connector coupling part 3. The inverter apparatus 1 and the transmission 2 are not fixed or integrated together excluding the coupling part of the connector 3. When installing the inverter apparatus 1 to the transmission 2, the installation operation is completed only by coupling their connecters to each other.

Figure 2A:
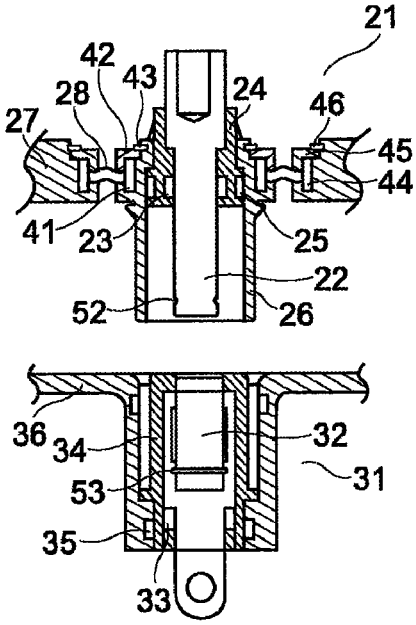
FIG. 2A is a side cross-sectional view of the first embodiment of the present invention, representing represents a pre-coupling.
Figure 2B:
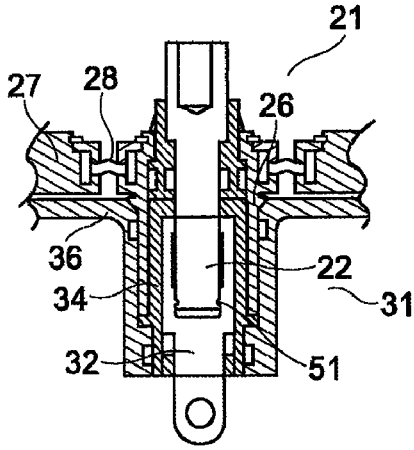
FIG. 2B is a side cross-sectional view of the first embodiment of the present invention, representing a post-coupling state.
Figure 3A:
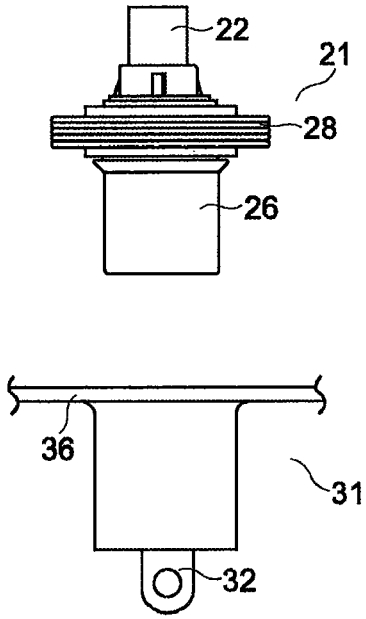
FIG. 3A is a cross-sectional view of the first embodiment of the present invention, representing a pre-coupling state.
Figure 3B:
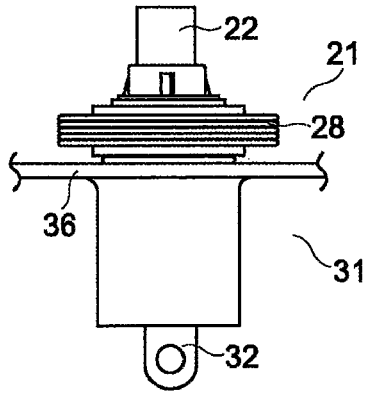
FIG. 3B is a cross-sectional view of the first embodiment of the present invention, representing a post-coupling state.

Next, referring to FIGS. 2A, 2B, 3A and 3B, the connector structure of this embodiment will be described. FIG. 2A is a side cross-sectional view of the connector structure, representing a pre-coupling state and FIG. 2B is a side cross-sectional view of the connector structure, representing a post-coupling state. FIG. 3A is a cross-sectional view of the connector structure, representing a pre-coupling state, and FIG. 3B is a cross-sectional view of the connector structure, representing a post-coupling state.

In the inverter apparatus side connector structure 21, a packing 23, an insulation member 24, a packing 25 and a terminal housing 26 are fixed at the outer circumference of the inverter apparatus side terminal 22 with its one end being formed as a male terminal structure having an approximately circular solid cylindrical shape, and the terminal housing 26 is fixed at the inverter apparatus side housing 27 with the dissipation member of vibration 28. The other end of the inverter apparatus side terminal 22 is connected electrically to the wiring inside the inverter apparatus. The insulation member 24 establishes electrical insulation between the inverter apparatus side terminal 22 and the terminal housing 26, and the packing 23 and 25 can assure waterproof for preventing water and oil from penetrating into the inside of the inverter apparatus.

The motor side connector structure 31 is fixed at the motor side housing 36 (the housing of the transmission 2) with the packing 33, the insulation member 34 and the packing 35 at the outer circumference of the motor side terminal 32 with its one end being formed as a female terminal structure having an approximately circular hollow cylindrical shape. The other end of the motor side terminal 32 is connected electrically to the wiring inside the motor. The insulation member 34 establishes electrical insulation between the motor side terminal 32 and the motor side housing 36, the packing 33 and 35 can assure waterproof for preventing water and oil from penetrating into the inside of the motor.

The dissipation member of vibration 28 is formed as circular ring packing with its cross sectional shape being formed approximately in an H-shape. The edge of the inner circumference of the circular ring packing is fit into the groove 41 of the terminal housing 26, the cover member 42 shaped in a circular ring is provided for covering the packing, and then the cover member 42 is fixed by C-ring 43 at the terminal housing 26 in order to fix the packing at the terminal housing 26. In the similar manner, the edge of the outer circumference of the circular ring packing is fit into the groove 44 of the inverter apparatus side housing 27, the cover member 45 shaped in a circular ring is provided for covering the packing, and then the cover member 45 is fixed by C-ring 46 at the inverter apparatus side housing 27 in order to fix the packing at the inverter apparatus side housing 27. The packing are formed so as to have an approximately U-shaped protuberance part at the center of its cross sectional shape being formed approximately in an H-shape in order to increase their elasticity. The packing may be composed of materials such as fluororesin, silicone and EP rubber. In case that the coupling part of the connector is affected by high temperature circumstantially dependent of the structure of the inverter apparatus, it is preferable to form the packing with fluororesin in order to increase the heat resistance of the packing. Note that, the dissipation member of vibration is not limited to the circular ring packing with its cross sectional shape being formed approximately in an H-shape as described in this embodiment, but that the packing may be formed in an elliptical or rectangular circular ring dependently upon the structure of the inverter apparatus side terminal and its housing to be applied. The cross section of the dissipation member of vibration may be shaped in I-shape, L-shape, T-shape or squared U-shape (square without one segment) according to the structure of the inverter apparatus side terminal and the apparatus housing to be mounted on.

As shown in FIG. 2B, when coupling the inverter apparatus and the motor, the inverter apparatus side terminal 22 formed as a male terminal structure having an approximately circular solid cylindrical shape is inserted into the motor side terminal 32 formed as a female terminal structure having an approximately circular hollow cylindrical shape. At the same time, the protruding part formed as a circular hollow cylindrical shape at the inverter apparatus side housing 27 is inserted into the space formed as a circular hollow cylindrical shape between the insulation member 34 of the motor side connector structure and the motor side housing 36. In this connector configuration, when the inverter apparatus and the motor vibrate due to the vibrating movement of the automotive body, the coupling part of the connector vibrates in synchronization with the motor side housing 26 on which the motor side terminal 32 is fixed, and then, the relative vibrating movement between the inverter apparatus and the motor can be absorbed by the dissipation member of vibration 28 between the inverter apparatus side terminal 22 and the inverter apparatus side housing 27.

In the connector structure in this embodiment, as the inverter apparatus side terminal 22 is fixed at the inverter apparatus side housing 27 through the dissipation member of vibration 28, the inverter apparatus side terminal 22 can vibrate freely in the horizontal and vertical directions on the figure. Due to the vibrating movement of the inverter apparatus and the motor, there may occurs such a possibility that, in the post-coupling state, the inverter apparatus side terminal 22 vibrates in the vertical direction on the figure, and hence that the contact condition between the terminals may be destabilized. In order to solve this problem, the engaging mechanism 51 is provided in this embodiment in order to limit the relative movement in the vertical direction on the figure between the inverter apparatus side terminal 22 and the motor side terminal 32. The engaging mechanism 51 is composed of a concave part 52 formed at the outer circumference of the inverter apparatus side terminal 22 formed as a male terminal having an approximately circular solid cylindrical shape, a concave part 53 formed at the inner circumference of the motor side terminal 32 formed as a female terminal having an approximately circular hollow cylindrical shape, and a ring member contained within a space formed by the concave part of the inverter apparatus side terminal 22 and the concave part of the motor side terminal 32. The ring member is formed by C-ring composed of stainless steel and the like. The ring member is arranged in advance at the concave part 53 of the motor terminal 32 formed as a female terminal, and then, when inserting the inverter apparatus side terminal 22 formed as a male terminal, the ring member is engaged into the concave part 52 of the inverter apparatus side terminal 22. When the inverter apparatus side terminal 22 and the motor side terminal 32 are coupled to each other, the movement of the inverter apparatus side terminal 22 in the vertical direction on the figure is prohibited by the ring member provided at the space formed by the concave part of the inverter apparatus side terminal 22 and the concave part of the motor side terminal 32.

Figure 4A:
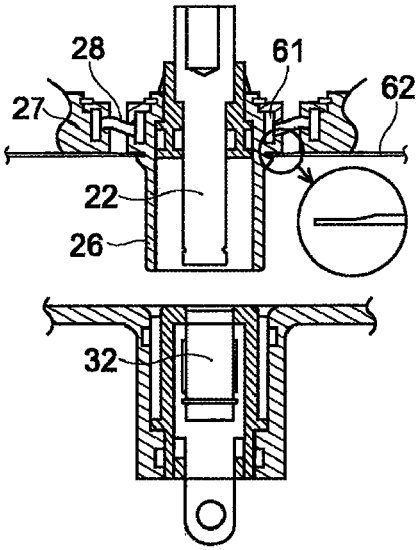
FIG. 4A is a diagram illustrating a coupling method of the first embodiment of the present invention, representing a side cross-sectional view of the pre-coupling state.
Figure 4B:
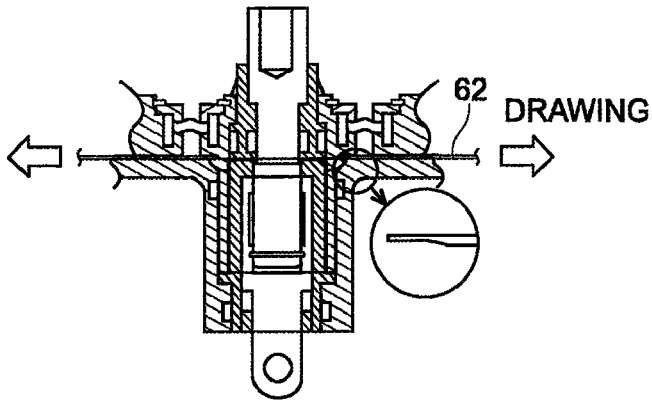
FIG. 4B is a diagram illustrating a coupling method of the first embodiment of the present invention, representing a side cross-sectional view of the post-coupling state.

Next, referring to FIGS. 4A and 4B, a coupling method preferable for this embodiment will be described. As the inverter apparatus side terminal 22 is installed at the inverter side housing 27 through the dissipation member of vibration 28 in the connector structure of this embodiment, the inverter apparatus side terminal 22 can move to and fro in the vertical and horizontal directions on the figures. Therefore, the inverter apparatus side terminal 22 may move into the upper direction in the figure when inserting the inverter apparatus side terminal 22 into the motor side terminal 32, which may cause such a possibility that the inverter apparatus side terminal 22 can not inserted and connected firmly to the motor side terminal 32. In order to solve this problem, a groove 61 is provided at the outer circumference of the terminal housing 26 in this embodiment. At the pre-coupling state as shown in FIG. 4A, the top of the terminal movement limiting member 62 is inserted at the groove 61 in order to limit the movement of the terminal housing 26 and the inverter apparatus side terminal 22 to be bounded in the vertical direction on the figure. The thickness of the top of the terminal movement limiting member 62 preferably changes at its positions where the top is inserted at the groove 61 and the top contacts to the inverter apparatus side housing 27 so that the terminal housing 26 may extend a little over the inverter apparatus side housing 27. The inverter apparatus side terminal 22 may be inserted into the motor side terminal 32 where the movement of the terminal housing 26 in the vertical direction on the figure is limited by the terminal movement limiting member 62. After inserting and coupling the inverter apparatus side terminal 22, the terminal movement limiting member 62 is drawn and removed from the groove 61. According to this coupling method, the coupling between the inverter side terminal 22 and the motor side terminal 32 can be established firmly in the connector structure of this embodiment.

Figure 5A:
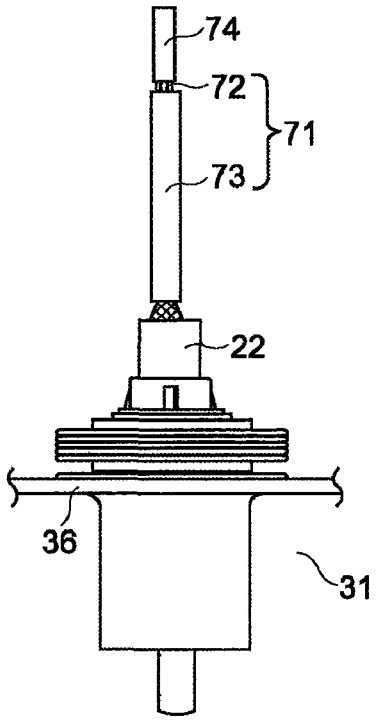
FIG. 5A is a diagram illustrating a configuration of providing an electric line to the inverter apparatus-side terminal of the first embodiment of the present invention, shown in a side view.
Figure 5B:
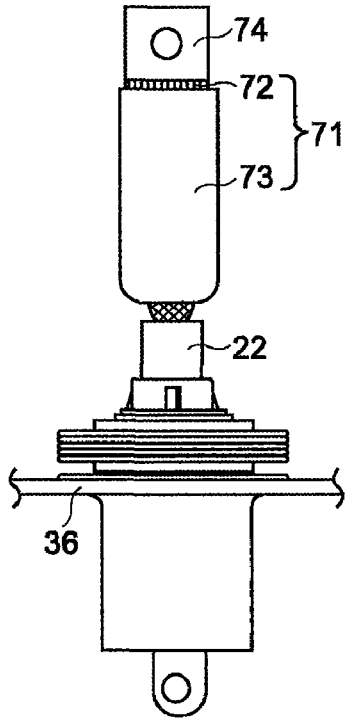
FIG. 5B is a diagram illustrating a configuration of providing an electric line to the inverter apparatus-side terminal of the first embodiment of the present invention, shown in a front view.

FIGS. 5A and 5B show schematically the configuration in which the electric connecting line 71 for connecting electrically the inverter apparatus side terminal 22 and the wiring inside the inverter apparatus is provided at the inverter apparatus side terminal 22 in the connector structure of this embodiment; FIG. 5A is a side view and FIG. 5B is a front view. In the connector structure of this embodiment, the inverter apparatus side terminal 22 is fixed at the motor side housing 36 at the post-coupling state and vibrates subject to the vibration of the motor side housing 36. On the other hand, the wiring inside the inverter apparatus connected electrically to the other end of the inverter apparatus terminal 22 is fixed at the inverter apparatus side housing 27 and vibrates together with the inverter apparatus side housing 27. Therefore, the inverter apparatus side terminal 22 and the wiring inside the inverter apparatus moves relatively to each other due to this vibration. Thus, it is preferable that the electric connecting line 71 for connecting electrically the other end of the inverter side terminal 22 and the wiring inside the inverter apparatus has flexibility. The electric connecting line 71 in this embodiment is composed of an electrically conductive plain braided wire 72 and an insulative and heat-shrinkable tube 73 installed at the outer circumference of the plain braided wire 72. As the electric connecting line 71 in this embodiment is composed of the electrically conductive plain braided wire 72 and the insulative and heat-shrinkable tube 73, the electric connecting line 71 can be inflective in response to the vibrating movement. As for the electric connecting line, any type of electric cable having flexibility can be applied other than the electric connecting line in this embodiment.

(Operation)

According to the connector structure in this embodiment, the inverter side terminal is fixed at the inverter apparatus side terminal through composed of the circular ring packing with its cross sectional shape being formed approximately in an H-shape as well as the motor side terminal is fixed at the motor side housing. Therefore, it will be appreciated that, when coupling the inverter side terminal and the motor side terminal, the terminal movement limiting member can absorb the relative vibrating movement between the inverter apparatus and the motor. Thus, it will be appreciated that the excessive load due to this vibrating movement can be prevented from being applied to the coupling part of the connector.

By means that the cross sectional shape of the dissipation member of vibration are formed so as to have an approximately U-shaped protuberance part at the center of its cross sectional shape, it will be appreciated that the elasticity of the dissipation member of vibration can be increased and that the vibrating movement of the inverter apparatus and the motor can be absorbed efficiently.

It will be appreciated that the connector structure in this embodiment can be applied in the high-temperature environment by way of forming the dissipation member of vibration with fluororesins.

It will be appreciated that the vibrating movement of the inverter apparatus side terminal due to the vibrating movement of the inverter apparatus and the motor at the post-coupling state can be limited because the engaging mechanism is provided for engaging the inverter apparatus side terminal and the motor side terminal together.

As the electrical connecting line having flexibility connects between the inverter apparatus side terminal and the wiring inside the inverter apparatus, it will be appreciated that the relative movement between the inverter apparatus side terminal and the wiring inside the inverter apparatus can be absorbed by the electric connecting line.

Embodiment 2 Structure

Figure 6A:
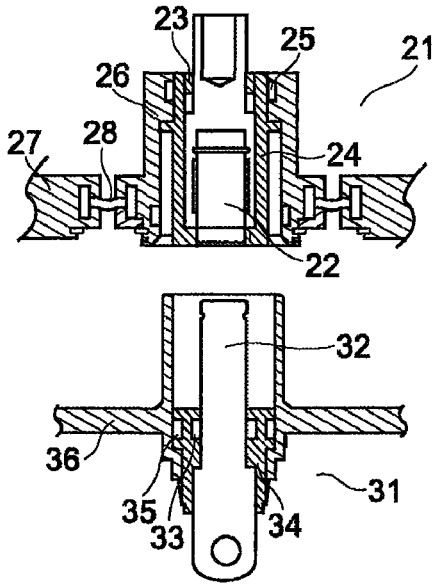
FIG. 6A is a side cross-sectional view of the second embodiment of the present invention, representing a pre-coupling state.

Next, referring to FIGS. 6 and 7, the second embodiment of the present invention will be described.

The difference in this Embodiment 2 from Embodiment 1 is that the inverter apparatus side terminal is formed as a female terminal having an approximately circular hollow cylindrical shape and the motor side terminal is formed as a male terminal having an approximately circular solid cylindrical shape.

In the inverter apparatus side connector structure 21, a packing 23, an insulation member 24, a packing 25 and a terminal housing 26 are fixed at the outer circumference of the inverter apparatus side terminal 22 with its one end being formed as a female terminal structure having an approximately circular hollow cylindrical shape, and the terminal housing 26 is fixed at the inverter apparatus side housing 27 with the dissipation member of vibration 28. The other end of the inverter apparatus side terminal 22 is connected electrically to the wiring inside the inverter apparatus.

The motor side connector structure 31 is fixed at the motor side housing 36 with the packing 33, the insulation member 34 and the packing 35 at the outer circumference of the motor side terminal 32 with its one end being formed as a male terminal structure having an approximately circular solid cylindrical shape. The other end of the motor side terminal 32 is connected electrically to the wiring inside the motor.

Figure 6B:
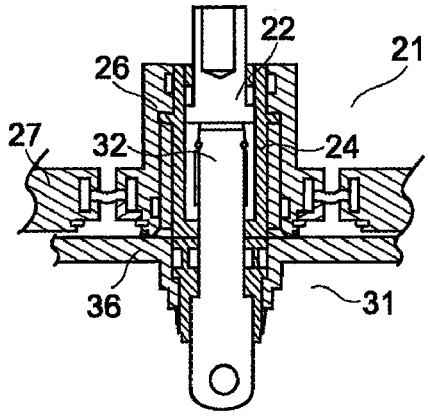
FIG. 6B is a side cross-sectional view of the second embodiment of the present invention, representing a post-coupling state.
Figure 7A:
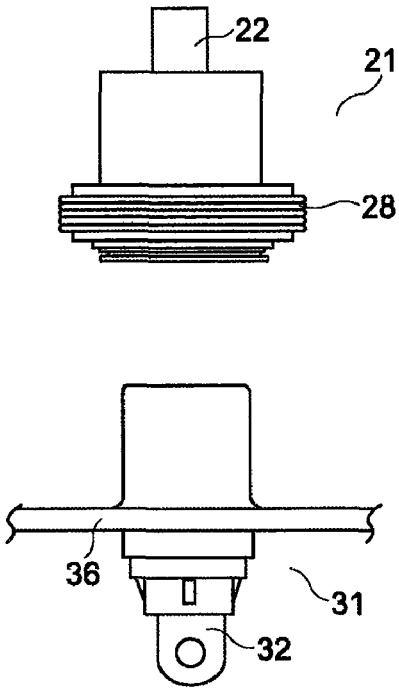
FIG. 7A is a cross-sectional view of the second embodiment of the present invention, representing a pre-coupling state.
Figure 7B:
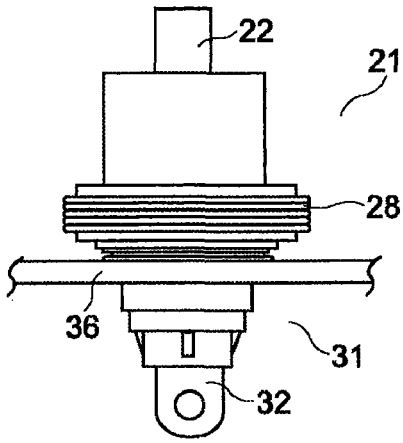
FIG. 7B is a cross-sectional view of the second embodiment of the present invention, representing a post-coupling state.

As shown in FIG. 6B, when coupling the inverter apparatus and the motor, the motor side terminal 32 formed as a male terminal structure having an approximately circular solid cylindrical shape is inserted into the inverter apparatus side terminal 22 formed as a female terminal structure having an approximately circular hollow cylindrical shape. At the same time, the protruding part formed as a circular hollow cylindrical shape at the motor side housing 36 is inserted into the space formed as a circular hollow cylindrical shape between the insulation member 24 and the terminal housing 26 of the inverter apparatus side connector structure 21.

(Operation)

The similar operation to Embodiment 1 can be obtained also in the connector structure in this Embodiment 2.

Embodiment 3 Structure

Next, referring to FIGS. 8A, 8B, 9A and 9B, Embodiment 3 of the present invention will be described.

The difference in this Embodiment 3 from Embodiment 1 is that the inverter apparatus side terminal is fixed at the inverter side housing, and the motor side terminal is installed at the motor side housing through the dissipation member of vibration.

The inverter apparatus side connector structure 21 is fixed at the inverter apparatus side housing 27 through the packing 23, the insulation member 24, the packing 25 at the outer circumference of the inverter apparatus side terminal 22 with its one end being formed as a male terminal structure having an approximately circular solid cylindrical shape. The other end of the inverter apparatus side terminal 22 is connected electrically to the wiring inside the inverter apparatus.

In the motor side connector structure 31, the packing 33, the insulation member 34, the packing 35 and the terminal housing 26' are fixed at the outer circumference of the motor side terminal 32 with its one end being formed as a female terminal structure having an approximately circular hollow cylindrical shape, and the terminal housing 26' is fixed at the motor side housing 36 through the dissipation member of vibration 28. The other end of the motor side terminal 32 is connected electrically to the wiring inside the motor.

Figure 8A:
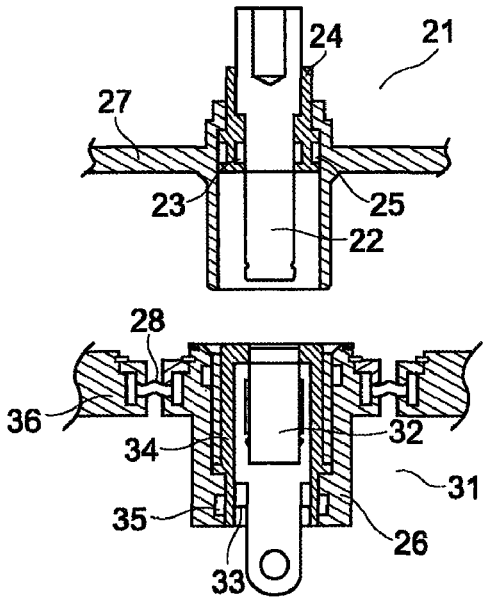
FIG. 8A is a side cross-sectional view of the third embodiment of the present invention, representing a pre-coupling state.
Figure 8B:
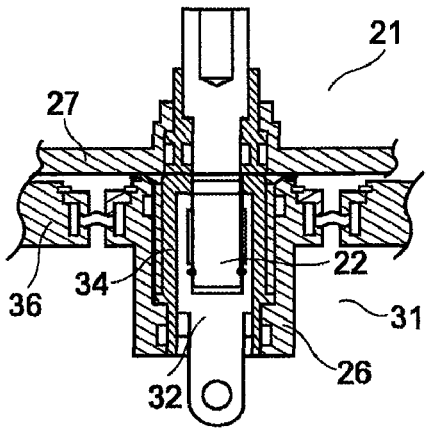
FIG. 8B is a side cross-sectional view of the third embodiment of the present invention, representing a post-coupling state.
Figure 9A:
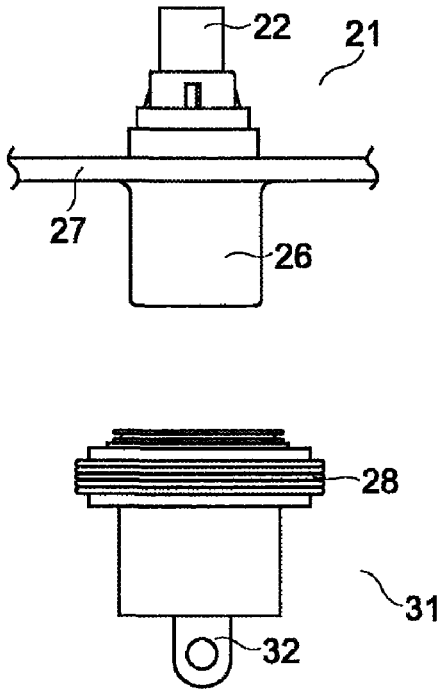
FIG. 9A is a cross-sectional view of the third embodiment of the present invention, representing a pre-coupling state.
Figure 9B:
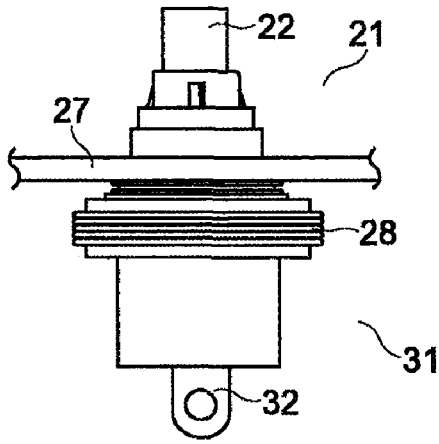
FIG. 9B is a cross-sectional view of the third embodiment of the present invention, representing a post-coupling state.

As shown in FIG. 8B, when coupling the inverter apparatus and the motor, the inverter apparatus side terminal 22 formed as a male terminal structure having an approximately circular solid cylindrical shape is inserted into the motor side terminal 32 formed as a female terminal structure having an approximately circular hollow cylindrical shape. At the same time, the protruding part formed as a circular hollow cylindrical shape at the inverter apparatus side housing 27 is inserted into the space formed as a circular hollow cylindrical shape between the insulation member 24 and the terminal housing 26' of the motor side connector structure 31.

(Operation)

The similar operation to Embodiment 1 can be obtained also in the connector structure in this Embodiment 3.

Embodiment 4 Structure

Figure 10A:
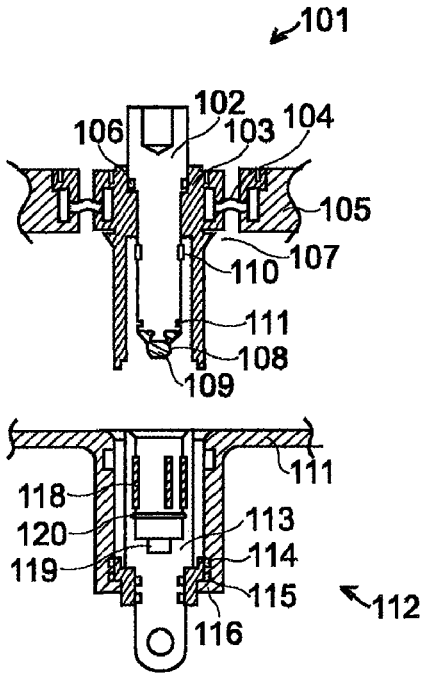
FIG. 10A is a side cross-sectional view of the forth embodiment of the present invention, representing a pre-coupling state.
Figure 10B:
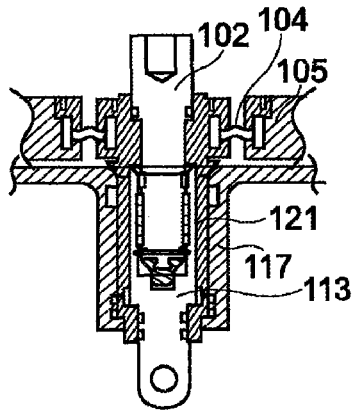
FIG. 10B is a side cross-sectional view of the forth embodiment of the present invention, representing a post-coupling state.

Next, referring to FIGS. 10A and 10B, Embodiment 4 of the present invention will be described. FIG. 10A is a side cross-sectional view of the connector structure in this embodiment, representing a pre-coupling state and FIG. 10B is a side cross-sectional view of the connector structure in this embodiment, representing a post-coupling state.

In the inverter apparatus side connector structure 101, the terminal housing 103 are fixed at the outer circumference of the inverter apparatus side terminal 102 with its one end being formed as a male terminal structure having an approximately circular solid cylindrical shape, and the terminal housing 103 is fixed at the inverter apparatus side housing 105 with the dissipation member of vibration 104. The other end of the inverter apparatus side terminal 102 is connected electrically to the wiring inside the inverter apparatus. O-ring 106 is installed between the inverter side terminal 102 and the terminal housing 103 in order to assure waterproof. The terminal housing 103 is composed of electrically insulative resin, and formed as an integrated structure of the insulation member 24 and the terminal housing 26 of Embodiment 1. The groove 107 for inserting the terminal movement limiting member is formed at the outer circumference of the terminal housing 103 in the similar manner to Embodiment 1. The inverter apparatus side connector structure 101 is so formed as to extend over the surface of the inverter apparatus side housing 105.

The axis position adjusting member 108 is provided at the top of one end of the inverter apparatus side terminal 102. The axis position adjusting member 108 is provided at the top of one end of the inverter apparatus side terminal 102 by engaging the convex part formed at the top of one end of the inverter apparatus side terminal 102 and the concave part formed at the axis position adjusting member 108. The axis position adjusting member 108 is composed of insulative resin.

The slide member 110 is provided at the outer circumference of the inverter apparatus side terminal 102. The slide member 110 is composed of abrasion-resistant and heat-resistant resin such as PPS. The slide member is formed as at least three or more discrete spots at the outer circumference of the inverter apparatus side terminal 102 or formed as a ring at the outer circumference of the inverter apparatus side terminal 102.

The concave part 111 for forming the engaging mechanism is provided at the outer circumference of the inverter apparatus side terminal 102 in the similar manner to Embodiment 1.

As the dissipation member of vibration 104 is the same as Embodiment 1, its structure is not described here in detail.

The motor side connector structure 112 is fixed at the motor side housing 117 (the housing of the transmission 2) with the O-ring 114, the insulation member 115 and the O-ring 116 at the outer circumference of the motor side terminal 113 with its one end being formed as a female terminal structure having an approximately circular hollow cylindrical shape. The other end of the motor side terminal 113 is connected electrically to the wiring inside the motor. The insulation member 115 establishes electrical insulation between the motor side terminal 113 and the motor side housing 117, and the O-rings 114 and 115 establishes waterproof for preventing water and oil from penetrating into the inside of the motor. In contrast to Embodiment 1 in which the insulation member 34 is provided so as to cover the whole part of the top of the motor side terminal 32, the insulation member 115 is provided at the limited part of the outer circumference of the motor side terminal 113 to be fixed at the motor side housing 117. The motor side connector structure 112 is formed as a shape so as to be contained inside the surface of the motor side housing 117.

A groove is formed at the inner circumference of the motor side terminal 113 formed in an approximately circular hollow cylindrical shape, and the contact maker 118 is formed at this groove. The contact maker 118 is composed of electrical conductive materials such as copper alloy.

The concave part 119 is formed at the inner bottom of the motor side terminal 113 formed in an approximately circular hollow cylindrical shape. The concave part 119 is shaped so as to be engaged with the convex part 109 of the axis position adjusting member 108 formed at the top of the inverter apparatus side terminal 102.

A concave part for forming the engaging mechanism is formed at the inner circumference of the motor side terminal 113 formed in an approximately circular hollow cylindrical shape in the similar manner to Embodiment 1, and the ring member 120 is provided at this concave part in advance.

As shown in FIG. 10B, when connecting the inverter apparatus and the motor, the inverter apparatus side terminal 102 formed as a male terminal structure having an approximately circular solid cylindrical shape is inserted into the motor side terminal 113 formed as a female terminal structure having an approximately circular hollow cylindrical shape. At the same time, the protruding part 121 formed as a circular hollow cylindrical shape and extended from the inverter apparatus side housing 105 at the terminal housing 103 is formed between the motor side terminal 113 and the motor side housing 117, both of the motor side connector structure 112. In this connector configuration, when the inverter apparatus and the motor vibrate due to the vibrating movement of the automotive body, the coupling part of the connector vibrates in synchronization with the motor side housing 117 on which the motor side terminal 113 is fixed, and then, the relative vibrating movement between the inverter apparatus and the motor can be absorbed by the dissipation member of vibration 104 between the inverter apparatus side terminal 102 and the inverter apparatus side housing 105.

As the axis position adjusting member 108 is provided at the top of one end of the inverter apparatus side terminal 102 as well as the concave part 119 is formed at the bottom of the inner circumference of the motor side terminal 113 formed in an approximately circular hollow cylindrical shape in this embodiment, the axial alignment for the inverter apparatus side terminal 102 and the motor side terminal 113 is adjusted automatically by means that the convex part 109 of the axis position adjusting member 108 is engaged into the concave part 119 at the bottom of the inner circumference of the motor side terminal 113 formed in an approximately circular hollow cylindrical shape, when inserting the inverter apparatus side terminal 102 into the motor side terminal 113.

In the state in which the inverter apparatus side terminal 102 is inserted into the motor side terminal 113, the outer circumference of the inverter apparatus side terminal 102 contacts to the contact maker 118 provided at the groove formed at the inner circumference of the motor side terminal 113. Thus, the electrical connection between the inverter apparatus side terminal 102 and the motor side terminal 113 is established by the contact maker 118.

Further, as the slide member 110 is provided at the outer circumference of the inverter apparatus side terminal 102 in this embodiment, in the state in which the inverter apparatus side terminal 102 is inserted into the motor side terminal 113, the slide member 110 is arranged between the outer circumference of the inverter apparatus side terminal 102 and the inner circumference of the motor side terminal 113, and thus, the outer circumference of the inverter apparatus side terminal 102 does not contact directly to the inner circumference of the motor side terminal 113. In case that vibrating movement occurs, the inverter apparatus side terminal 102 and the motor side terminal 113 moves relatively to each other through the sliding member 110.

(Operation)

The similar operation to Embodiment 1 can be obtained also in the connector structure in this Embodiment 4.

In this embodiment as described above, as the terminal housing of the inverter apparatus side connector structure is composed of electrically insulative resin, and the terminal housing and the insulation member of Embodiment 1 are integrated into a single unit together, it will be appreciated that the connector structure can be simplified and its cost can be reduced.

Further, as the axis position adjusting member is provided at the top of one end of the inverter apparatus side terminal as well as the concave part is formed at the bottom of the inner circumference of the motor side terminal formed in an approximately circular hollow cylindrical shape, it will be appreciated that the axial alignment for the inverter apparatus side terminal and the motor side terminal can be adjusted automatically, when inserting the inverter apparatus side terminal into the motor side terminal.

In addition, as the electrical connection between the inverter apparatus side terminal and the motor side terminal is established by the contact maker as well as the slide member is arranged between the outer circumference of the inverter apparatus side terminal and the inner circumference of the motor side terminal, it will be appreciated that the outer circumference of the inverter apparatus side terminal does not contact directly to the inner circumference of the motor side terminal. Therefore, it will be appreciated that the friction between the outer circumference of the inverter apparatus side terminal and the inner circumference of the motor side terminal can be reduced, and hence that the mechanical damage to the outer circumference of the inverter apparatus side terminal and the inner circumference of the motor side terminal can be prevented, and abrasion of plating, if any formed on the surface of the terminal, can be prevented.

Embodiment 5

(Structure)

Figure 11A:
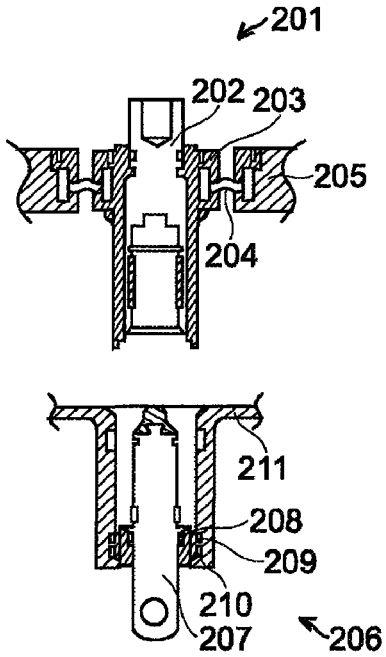
FIG. 11A is a side cross-sectional view of the fifth embodiment of the present invention, representing a pre-coupling state.

Next, referring to FIGS. 11A and 11B, Embodiment 5 of the present invention will be described. FIG. 11A is a side cross-sectional view of the connector structure in this embodiment, representing a pre-coupling state and FIG. 11B is a side cross-sectional view of the connector structure in this embodiment, representing a post-coupling state.

In the inverter apparatus side connector structure 201, the terminal housing 203 composed of electrically insulative material are fixed at the outer circumference of the inverter apparatus side terminal 202 with its one end being formed as a female terminal structure having an approximately circular hollow cylindrical shape, and the terminal housing 203 is fixed at the inverter apparatus side housing 205 with the dissipation member of vibration 204. The other end of the inverter apparatus side terminal 202 is connected electrically to the wiring inside the inverter apparatus. The inverter apparatus side connector structure 201 is so formed as to extend over the surface of the inverter apparatus side housing 205.

The motor side connector structure 206 is fixed at the motor side housing 211 with the O-ring 208, the insulation member 209 and the O-ring 210 at the outer circumference of the motor side terminal 207 with its one end being formed as a male terminal structure having an approximately circular solid cylindrical shape. The other end of the motor side terminal 207 is connected electrically to the wiring inside the motor. The motor side connector structure 206 is formed as a shape so as to be contained inside the surface of the motor side housing 211.

Figure 11B:
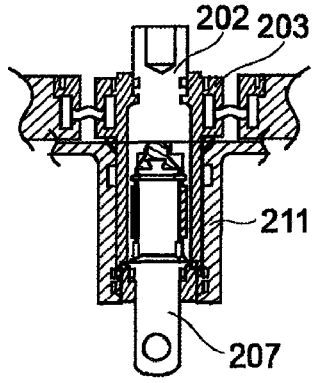
FIG. 11B is a side cross-sectional view of the fifth embodiment of the present invention, representing a post-coupling state.

As shown in FIG. 11B, when connecting the inverter apparatus and the motor, the motor side terminal 207 formed as a male terminal structure having an approximately circular solid cylindrical shape is inserted into the inverter apparatus side terminal 202 formed as a female terminal structure having an approximately circular hollow cylindrical shape. At the same time, the protruding part formed as a circular hollow cylindrical shape and formed by the inverter apparatus side terminal 202 and the motor housing 203 is inserted into the space formed as a circular hollow cylindrical shape between the motor side terminal 207 and the motor side housing 211.

(Operation)

The similar operation to Embodiment 4 can be obtained also in the connector structure in this Embodiment 5.

Embodiment 6

(Structure)

Figure 12A:
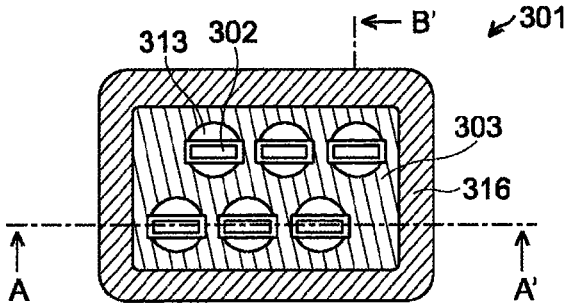
FIG. 12A is a front view of the inverter apparatus side connector structure of the sixth embodiment of the present invention.
Figure 12B:
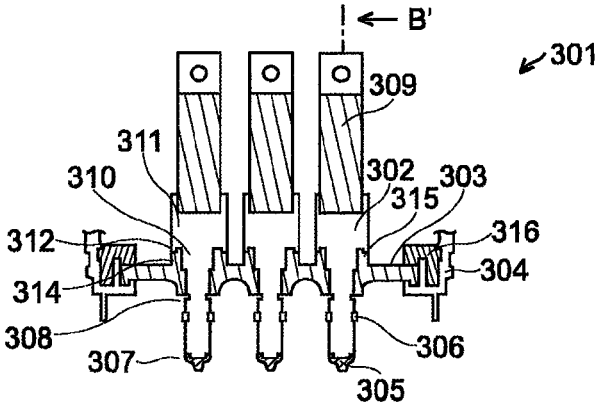
FIG. 12B is an A-A' cross-sectional view of the inverter apparatus side connector structure of the sixth embodiment of the present invention.
Figure 12C:
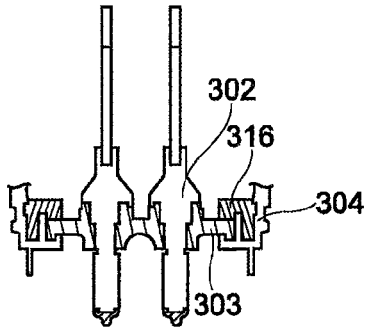
FIG. 12C is a B-B' cross-sectional view of the inverter apparatus side connector structure of the sixth embodiment of the present invention.
Figure 13A:
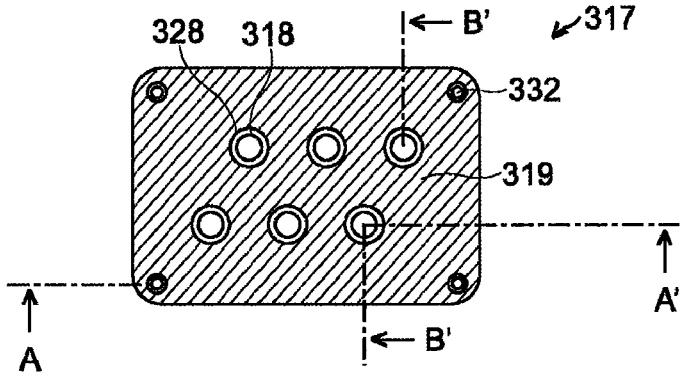
FIG. 13A is a front view of the motor side connector structure of the sixth embodiment of the present invention.
Figure 13B:
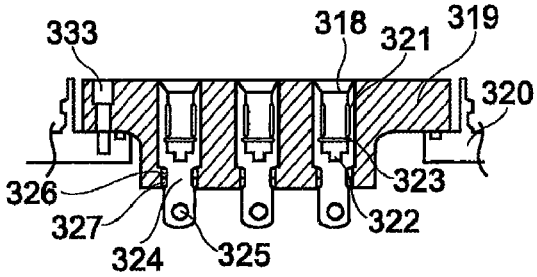
FIG. 13B is an A-A' cross-sectional view of the motor side connector structure of the sixth embodiment of the present invention.
Figure 13C:
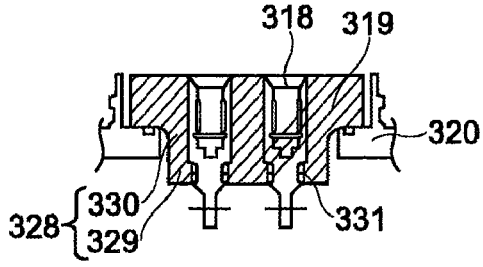
FIG. 13C is a B-B' cross-sectional view of the motor side connector structure of the sixth embodiment of the present invention.
Figure 14:
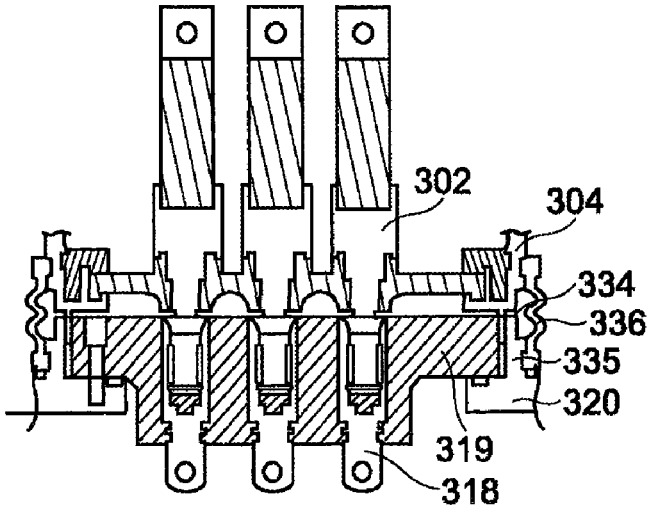
FIG. 14 is a post-coupling state of the connector structure of the sixth embodiment of the present invention.

Next, referring to FIGS. 12A, 12B, 12C, 13A, 13B and 14, Embodiment 6 of the present invention will be described. FIG. 12A is a front view of the inverter apparatus side connector structure in this embodiment, FIG. 12B is an A-A' cross-sectional view of the inverter apparatus side connector structure in this embodiment and FIG. 12C is a B-B' cross-sectional view of the inverter apparatus side connector structure in this embodiment. FIG. 13A is a front view of the motor side connector structure in this embodiment and FIG. 13B is an A-A' cross-sectional view of the motor side connector structure in this embodiment. FIG. 14 is a post-coupling state of the connector structure in this embodiment.

The inverter apparatus side connector structure 301 as shown in FIGS. 12A, 12B and 12C, is so configured that six inverter apparatus side terminals 302 are fixed at the dissipation member of vibration 303, and that the dissipation member of vibration 303 is provided at the inverter apparatus side housing 304. The inverter apparatus side connector structure 301 is so formed as to extend over the surface of the inverter apparatus side housing 304.

The individual inverter apparatus side terminal 302 is formed as a male terminal structure having an approximately circular solid cylindrical shape. The axis position adjusting member 305 is provided at the top of one end of the individual inverter apparatus side terminal 302 in the similar manner to Embodiment 4. The slide member 306 is provided at the outer circumference of the approximately circular solid cylindrical part of one end of the inverter apparatus side terminal in the similar manner to Embodiment 4. The concave part 307 is provided at the outer circumference of the top of the approximately circular solid cylindrical part of one end of the inverter apparatus side terminal in the similar manner to Embodiment 1 in order to form the engaging mechanism. Further, the groove 308 for inserting the terminal movement limiting member is formed at the approximately circular solid cylindrical part of one end of the inverter apparatus side terminal in the similar manner to Embodiment 1. The plain braided wire 309 having flexibility is connected to the other end of the individual inverter apparatus side terminal 302. The plain braided wire 309 is connected electrically to the wiring inside the inverter apparatus.

The approximately circular solid cylindrical shape part of the individual inverter apparatus side terminal 302 includes the first larger diameter part 310 having a diameter larger than the diameter of the circular solid cylindrical shape part at the top of the inverter apparatus side terminal and the second larger diameter part 311 having a diameter larger than the diameter of the first larger diameter part 310. The groove 312 is formed on the cross-sectional interface at the boundary between the first larger diameter part 310 and the second larger diameter part 311. The hole 313 is formed at the dissipation member of vibration 303 in order to fix the inverter apparatus side terminal 302. The top of the circular solid cylindrical shape part of the inverter apparatus side terminal 302 can be inserted through the hole 313, and the hole 313 is formed with a diameter smaller than the diameter of the first larger diameter part 310. The protruding part 314 formed as a circular hollow cylindrical shape having a diameter larger than the diameter of the first larger diameter part 310 and allowed to be inserted into the groove 312 provided at the cross-sectional interface of the second larger diameter part 311 located at the boundary between the first larger diameter part 310 and the second larger diameter part 311 is provided at the inverter apparatus inside in the neighborhood of the hole 313 (at the upper side of FIG. 12B).

The one end of the inverter apparatus side terminal 302 is inserted through the hole 313 of the dissipation member of vibration 303 from the inside of the inverter apparatus. The inverter apparatus side terminal 302 and the hole 313 are engaged to each other at the boundary position between the top of the circular solid cylindrical shape part of the inverter apparatus side terminal 302 and the first larger diameter part 310, and the protruding part 314 formed as a circular hollow cylindrical shape at the neighborhood of the hole 313 is inserted into the groove 312 provided at the cross-sectional interface of the second larger diameter part 311. In this state, by providing the fixing band 315 at the outer circumference of the protruding part formed as a circular hollow cylindrical shape, the inverter apparatus side terminal 302 is fixed at the dissipation member of vibration 303.

The dissipation member of vibration 303 is a plate formed in an approximately rectangular shape, and composed of fluororesin, silicone and EP rubber. Six holes 313 arranged in a couple of arrays, each array containing three holes, are formed at the dissipation member of vibration 303. Three holes of the individual array are arranged so that they may not be aligned in the vertical direction (in the vertical direction on FIG. 12A). As described above, the inverter apparatus side terminal 302 is fixed at the individual hole 313. The edge of the outer circumference of the dissipation member of vibration 303 formed as an approximately rectangular shape has a cross sectional shape being formed approximately in a T-shape. The edge of the outer circumference may be contained in the groove of the inverter apparatus side housing 304, and covered by the cover member 316 formed in a rectangular ring shape, and then, the dissipation member of vibration 303 may be fixed at the inverter apparatus side housing 304.

The motor side connector structure 317, as shown in FIGS. 13A and 13B, is configured so that six motor side terminals 318 are fixed at the terminal housing 319, and that the terminal housing 319 is fixed at the motor side housing 320. The motor side connector structure 317 is also configured so that the motor side terminal 318 may not extend over the surface of the terminal housing 319.

One end of the individual motor side terminal 318 is formed as a female terminal structure having an approximately circular hollow cylindrical shape. A groove is formed at the inner circumference of the approximately circular hollow cylindrical shape part of the individual motor side terminal 318 in the similar manner to Embodiment 4, and the contact maker 321 is formed at this groove. The concave part 322 to be engaged with the convex part of the axis position adjusting member 305 of the inverter apparatus side terminal 302 is formed at the inner bottom of the approximately circular hollow cylindrical shape part of the individual motor side terminal 318. A concave part for forming the engaging mechanism is formed at the inner circumference of the approximately circular hollow cylindrical shape part of the individual motor side terminal 318 in the similar manner to Embodiment 1, and the ring member 323 is provided at this concave part in advance.

The approximately circular hollow cylindrical shape part of the individual motor side terminal 318 has the smaller diameter part 324 having a diameter smaller than the diameter of the approximately circular hollow cylindrical shape part at the top of the motor side terminal, and the terminal 325 for the wiring inside the motor apparatus to be connected to the wiring inside the motor apparatus is formed at the smaller diameter part 324 toward the inside of the motor apparatus (toward the lower side in FIG. 13B). The terminal 325 for the wiring inside the motor apparatus is formed so as to have a diameter smaller than the diameter of the approximately circular hollow cylindrical shape part at the top of the motor side terminal. The first concave part 326 is formed at the outer circumference of the smaller diameter part 324 and the second concave part 326 is formed to be closer to the terminal for the wiring inside the motor apparatus than the first concave part 326 (toward the lower side in FIG. 13B) at the outer circumference of the smaller diameter part 324. A hole 328 is formed at the terminal housing 319 for installing the motor side terminal 318. The diameter of the hole 328 is smaller than the diameter of the approximately circular hollow cylindrical shape part of the motor side terminal 318, and composed of the first circular hollow cylinder part 329 through which the terminal 325 for the wiring inside the motor apparatus and the smaller diameter part 324 at the motor side terminal 318 can be inserted and the second circular hollow cylinder part 330 through which the approximately circular hollow cylindrical part at the motor side terminal 318 can be inserted. The protruding part 33 to be engaged with the second concave part 327 at the motor side terminal 318 is provided at the first circular hollow cylinder part 329.

The motor side terminal 318 may be inserted through the terminal 325 for the wiring inside the motor apparatus into the hole 328 of the terminal housing 319 from the outside of the motor apparatus (from the upper side in FIG. 13B). The motor side terminal 318 is engaged with the hole 328 by means that the approximately circular hollow cylindrical shape part of the motor side terminal 318 reaches the position inside the hole 328 corresponding to the first circular hollow cylinder part 329; and the motor side terminal 318 is installed at the terminal housing 319 by means that the protruding part 331 of the first circular hollow cylinder part 329 is engaged with the second concave part 327 of the motor side terminal 318. At the same time, O-ring provided at the first concave part 326 contacts firmly to the terminal housing 319 in order to assure waterproof.

The terminal housing 319 is a plate formed in an approximately rectangular shape, and composed of hard resin. Six holes 328 arranged in a couple of arrays, each array containing three holes, corresponding to the inverter apparatus side connector structure, are formed at the terminal housing 319. The motor side terminal 318 is fixed at the individual hole 328 as described above. The terminal housing 319 has holes 332 for set screws at four corners. The terminal housing 319 can be fixed at the motor side housing 320 by means that the terminal housing 319 is arranged on the motor side housing 320 and fixed by the set screws 333.

As shown in FIG. 14, when coupling the inverter apparatus and the motor, the inverter apparatus side terminal 302 formed as a male terminal structure having an approximately circular solid cylindrical shape is inserted into the motor side terminal 318 formed as a female terminal structure having an approximately circular hollow cylindrical shape. At the same time, the protruding part 334 formed so as to extend over the surface of the inverter apparatus side housing 304 is inserted into the space between the protruding part 335 formed so as to extend over the surface of the motor side housing 320 of the motor side connector structure and the terminal housing 319.

Further, in this embodiment, at the post-coupling state as shown in FIG. 14, waterproof packing 336 is provided along the outer circumference of the coupling part of the connector in order to assure waterproof at the coupling part of the connector. The waterproof connector 336 is fixed by fixing its one end at the inverter apparatus side housing 304 and fixing its other end at the motor side housing 320.

(Operation)

As the inverter apparatus side terminal is fixed at the inverter apparatus side housing with the dissipation member of vibration and the motor side terminal is fixed at the motor side housing also in this embodiment in the similar manner to Embodiment 1, it will be appreciated that the relative vibrating movement between the inverter apparatus and the motor in this connector configuration can be absorbed by the dissipation member of vibration, and that the excessive load due to vibration may not be applied to the coupling part of the connector.

As plural inverter apparatus side terminals are fixed by a single dissipation member of vibration and the dissipation member of vibration is fixed at the inverter apparatus side housing in the connector configuration of this embodiment, it will be appreciated that, in contrast to the connector configuration in which the individual inverter apparatus side terminal is separately fixed at the inverter apparatus side housing by the dissipation member of vibration, the number of component parts may be reduced and the connector configuration may be simplified for contributing to cost-reduction.

As plural motor side terminals are fixed by a single terminal housing and the terminal housing is fixed at the motor side terminal in the connector configuration of this embodiment, it will be appreciated that, in contrast to the connector configuration in which the individual motor side terminal is separately fixed at the motor side housing, the number of component parts may be reduced and the connector configuration may be simplified for contributing to cost-reduction.

MODIFICATION EXAMPLE

As a modification example of this embodiment, it is allowed that the inverter apparatus side terminal may be formed as a female terminal and the motor side terminal is formed as a male terminal. Further, it is allowed that the inverter apparatus side terminal may be fixed at the inverter apparatus side housing, and the motor side terminal is fixed at the motor side housing through the dissipation member of vibration.

Embodiment 7

(Structure)

Figure 15A:
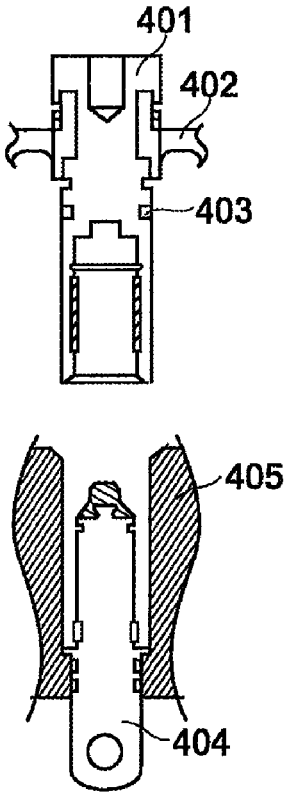
FIG. 15A is a side cross-sectional view of the seventh embodiment of the present invention, representing a pre-coupling state.
Figure 15B:
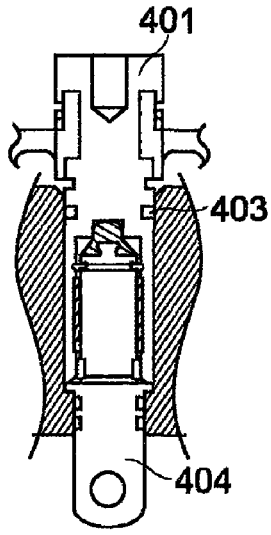
FIG. 15B is a side cross-sectional view of the seventh embodiment of the present invention, representing a post-coupling state.

Next, referring to FIGS. 15A and 15B, Embodiment 7 of the present invention will be described. FIG. 15A is a cross-sectional view of the connector structure of this embodiment, representing a pre-coupling state. FIG. 15B is a cross-sectional view of the connector structure of this embodiment, representing a post-coupling state.

This embodiment is a modification of Embodiment 6 in which plural terminals are bundled and fixed to the dissipation member of vibration. FIGS. 15A and 15B show a pair of terminals. The inverter apparatus side terminal 401 is formed as a female terminal structure having an approximately circular hollow cylindrical shape, and fixed at the dissipation member of vibration 402. Waterproof packing 403, for example, O-ring, is provided at the approximately circular hollow cylindrical shape part. The motor side terminal 404 is formed as a male terminal structure having an approximately circular solid cylindrical shape, and fixed at the terminal housing 405 composed of electrically insulative resin.

As shown in FIG. 14, when connecting the inverter apparatus and the motor, the motor side terminal 404 formed as a male terminal structure having an approximately circular solid cylindrical shape is inserted into the inverter apparatus side terminal 401 formed as a female terminal structure having an approximately circular hollow cylindrical shape. The waterproof packing 403 of the inverter apparatus side terminal 401 contacts firmly to the motor side terminal housing 405 in order to assure waterproof. As waterproof can be assured by the waterproof packing at the individual terminal when coupling the inverter apparatus and the motor in this embodiment, it will be appreciated that there is no need for the step of fixing the waterproof packing at the outer circumference of the coupling part after coupling the inverter apparatus and the motor, which step is required in Embodiment 6, and hence that the step for connector coupling can be simplified. In addition, the waterproof packing that is required in Embodiment 6 is not required in this embodiment, the cost of the connector structure can be reduced.

(Operation)

The similar operation to Embodiment 6 can be obtained also in the connector structure in this Embodiment 7.

As waterproof of the coupling part of the connector can be assured by the waterproof packing at the coupling part of the individual terminal in this embodiment as described above, it will be appreciated that the step for connector coupling can be more simplified and the cost of the connector structure can be more reduced in contrast to Embodiment 6.

Another Embodiment

In the above Embodiments 1 to 3, the structures and operations to be applied for a single pair of connectors are described. In the practical application for coupling the inverter apparatus and the motors, for example, in case of three-phase current electric motor, three pairs of connectors for U-phase, V-phase and W-phase are used for coupling between the inverter apparatus and the motor, and thus, six pairs of connectors are used for coupling the inverter apparatus and the motors in case that a couple of motors are installed inside the transmission 2. Thus, in case of applying the connector coupling between plural connectors, the connector structure according to the present invention can be applied to the individual pair of connectors.

In the above Embodiments 1 to 3, the coupling between the power converter apparatus (inverter apparatus) and the electric motor (motor). The connector structure according to the present invention can be also applied to the coupling between the battery and the power converter apparatus. The connector structure according to the present invention can be applied for coupling the apparatus under the environment in which mechanical vibration may occur.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments, which can be embodied within a scope encompassed and equivalent thereof with respect to the feature set out in the appended claims.

What is claimed is:

1. An assembly, comprising:

a first equipment having a first equipment housing;

a first terminal having a terminal housing separate from the first equipment housing;

a dissipation member for absorbing vibration extending from the terminal housing to the first equipment housing and being substantially transverse to an axis of the first terminal to the first equipment housing such that the first terminal and the first equipment housing are moveable relative to each other;

a second equipment having a second terminal and a second equipment housing in which is directly fixed the second terminal to which the first terminal is to be connected; and an axis position adjusting mechanism for adjusting an axis position of the first terminal and the second terminal when the first terminal and the second terminal are connected to each other, wherein said axis position adjusting mechanism is composed of a convex part formed at a top of the first or second terminal formed as a male terminal, and a concave part formed at a bottom of an inner circumference of the second or first terminal formed as a female terminal.

2. An assembly comprising:

a first equipment having a first equipment housing;

a first terminal having a terminal housing separate from the first equipment housing;

a dissipation member for absorbing vibration extending from the terminal housing to the first equipment housing and being substantially transverse to an axis of the first terminal to the first equipment housing such that the first terminal and the first equipment housing are moveable relative to each other;

a second equipment having a second terminal and a second equipment housing in which is directly fixed the second terminal to which the first terminal is to be connected; and an axis position adjusting mechanism for adjusting an axis position of the first terminal and the second terminal when the first terminal and the second terminal are connected to each other, wherein said axis position adjusting mechanism is composed of a convex part formed at a top of the first or second terminal formed as a male terminal, and a concave part formed at a bottom of an inner circumference of the second or first terminal formed as a female terminal, and wherein an electrically insulative axis position adjusting member having a convex part is provided at a top of the first or second terminal formed as a male terminal.

3. An assembly comprising:

a first equipment having a first equipment housing;

a first terminal having a terminal housing separate from the first equipment housing;

a dissipation member for absorbing vibration extending from the terminal housing to the first equipment housing and being substantially transverse to an axis of the first terminal to the first equipment housing such that the first terminal and the first equipment housing are moveable relative to each other;

a second equipment having a second terminal and a second equipment housing in which is directly fixed the second terminal to which the first terminal is to be connected;

the first terminal is a male terminal; and the second terminal is a female terminal;

wherein waterproof of a coupling part of connector is assured by a waterproof member being provided at an outer circumference of the first or second terminal formed as a female terminal; the other of the first or second terminal being a male terminal that is fixed at an electrically insulative terminal housing; and the waterproof member and the terminal housing being arranged to contact firmly to each other when coupling the female terminal and the male terminal together.

4. An assembly, comprising:

an equipment having an equipment housing;

a terminal having a terminal housing separate from the equipment housing; and a dissipation member for absorbing vibration extending from the terminal housing to the equipment housing and being substantially transverse to an axis of the terminal such that the terminal and the equipment housing are relatively moveable, wherein the terminal is a male terminal structure, and wherein an electrically insulative axis position adjusting member having a convex part is provided at a top of the terminal which is configured as a male terminal.

* * * * *